US005457851A

United States Patent [19]

Mondini

[11] Patent Number: 5,457,851

[45] Date of Patent: Oct. 17, 1995

[54] COMBING MACHINE WITH EVENNESS AND WASTE MONITORING

[75] Inventor: Giancarlo Mondini, Winterthur, Switzerland

[73] Assignee: Maschinenfabrik Rieter AG, Winterthur, Switzerland

[21] Appl. No.: 98,348

[22] PCT Filed: Dec. 7, 1992

[86] PCT No.: PCT/CH92/00236

§ 371 Date: Aug. 31, 1993

§ 102(e) Date: Aug. 31, 1993

[87] PCT Pub. No.: WO93/12278

PCT Pub. Date: Jun. 24, 1993

[30] Foreign Application Priority Data

Dec. 9, 1991 [CH] Switzerland ..... 03620/91

[51] Int. Cl.[6] ..... D01G 19/00; D01G 21/00

[52] U.S. Cl. ..... 19/115 R; 19/236; 19/150; 19/239

[58] Field of Search ..... 19/115 R, 118 B, 19/218, 237–239, 240; 57/315, 92, 97, 98

[56] References Cited

U.S. PATENT DOCUMENTS

| | | | |
|---|---|---|---|
| 4,369,550 | 1/1983 | Meile | 19/240 |
| 4,974,296 | 12/1990 | Vidler | 19/239 |
| 5,007,136 | 4/1991 | Artzt et al. | 19/115 R X |
| 5,134,755 | 8/1992 | Jornot et al. | 19/239 |
| 5,161,111 | 11/1992 | Oehler et al. | 364/470 |
| 5,230,125 | 7/1993 | Clement et al. | 19/115 R |

FOREIGN PATENT DOCUMENTS

| | | | |
|---|---|---|---|
| 0376002 | 7/1990 | European Pat. Off. . | |
| 0408949 | 1/1991 | European Pat. Off. . | |
| 0410429 | 1/1991 | European Pat. Off. . | |
| 4113384 | 11/1991 | Germany . | |
| 4115820 | 11/1992 | Germany . | |
| 1498/90 | 5/1990 | Switzerland . | |
| 0232766 | 2/1986 | U.S.S.R. | 19/115 R |

*Primary Examiner*—Clifford D. Crowder
*Assistant Examiner*—Ismael Izaguirre
*Attorney, Agent, or Firm*—Sandler, Greenblum & Bernstein

[57] ABSTRACT

Combing machine. The combing machine includes a process control computer for the preparatory machine of a textile spinning mill, the former being located upstream of a combing machine which reacts to signals from the combing machine, which signals are representative both of the evenness of feed material supplied to a controlled drafting arrangement as well as of the comber waste share, with the computer producing a signal which is indicative of a change in the evenness behavior of the machines located upstream of the combing machine when the evenness of the feed material changes while the comber waste share remains unchanged. A method for operating the combing machine is also set forth.

21 Claims, 3 Drawing Sheets

COMBING MACHINE WITH EVENNESS AND WASTE MONITORING

CROSS REFERENCE TO RELATED APPLICATIONS

This application claims the priorities of both PCT Application No. PCT/CH92/00236, filed Dec. 7, 1992, and Swiss Application No. -03 620/91-4, filed Dec. 9, 1991. The invention also relates to further developments of the principles as set forth in Swiss patent application No. 1841/91 of Jun. 21, 1991 as well as patent application No. PCT/CH91/00140, both of which are also assigned to the assignee of this invention.

BACKGROUND OF THE INVENTION

1. Field of the Invention

In accordance with the previously-noted PCT application No. PCT/CH91/00140 it is possible to gain from a preparatory machine (such as a draw frame or a combing machine, for example) a signal representative of the behaviour of the previous machines in the processing line. A signal can be gained from the combing machine, in particular, which is representative of the short fibre share in the feed material and which is representative of the performance of the previous machines with respect to mixing.

2. Discussion of the Background of the Invention and Material Information

In accordance with previously-noted Swiss application No. 1841/91 it is possible to gain a signal from a controlled drafting arrangement which represents the evenness of the feed material and the respective performance of the previous machines. This drafting arrangement can be provided in the combing machine itself.

In accordance with a further pending Swiss patent application a combing machine is proposed with which a signal representative of the comber waste share can be gained. A respective process is also provided, according to which the comber waste of a combing head or a machine is periodically or continuously collected either partially or in its entirety and the respective quantity is measured and a respective signal is generated. In this respect it is not of importance how the comber waste is carried off by the combing head or the machine. This can either be made pneumatically or mechanically, for example (e.g. by means of a conveyor belt) or in any other suitable manner.

SUMMARY OF THE INVENTION

In accordance with the present invention, a combing machine with a fiber mass measuring device arranged after the combing heads of the combing machine, the combing machine being in combination with other fiber processing machines located upstream of the combing machine, the combing machine comprising: means for determining the comber waste occurring in the combing machine; and means for generating a signal representative of the evenness behaviour of the fiber mass being supplied to the combing machine, the signal-generating means being responsive both to the fiber mass determined by the measuring device as well as to the determination of the comber waste, so that a change in the evenness behaviour of the fiber processing machines located upstream of the combing machine is only deduced in the event that the comber waste share remains within preset tolerances while the evenness of the fiber mass as scanned by the measuring device changes.

In a further embodiment of the machine of this invention, the fiber mass measuring device is provided as an element of a controlled drafting arrangement including a control unit.

In another embodiment of the machine of this invention, the signal-generating means is only indirectly responsive to a signal supplied by the fiber mass measuring device. Preferably, the signal generating means is responsive to signals which are generated in the control unit.

In a differing embodiment of the machine of this invention, a computer is provided, in combination with both the combing machine and the other fiber processing machines located upstream of the combing machine, as the signal-generating means and that the computer is allocated to one of the combing machine, as a machine control unit, and a group of machines, as one of a group control unit, and a process control computer.

In accordance with the present invention, in a method for a combing machine with a fiber mass measuring device arranged after the combing heads of the combing machine, the combing machine being in combination with other fiber processing machines located upstream of the combing machine, the method comprises monitoring both the evenness of the fiber material supplied by the combing heads of the combing machine as well as the comber waste share; and forming a signal representative of a change in the evenness behaviour of the fiber processing machines located upstream of the combing machine when the evenness of the fiber material being monitored changes while the comber waste share remains unchanged.

A further embodiment of the method of this invention further includes: determining thresholds for both comber waste share and evenness, so that a change will only be recognized as such in the event that one of the thresholds is exceeded.

Another embodiment of the method of this invention, further includes: providing the fiber mass measuring device as an element of a controlled drafting arrangement including a control unit.

A differing embodiment of the method of this invention, further includes a signal generator means, wherein the signal-generating means is only indirectly responsive to a signal supplied by the measuring device.

A final combination of the method of this invention, further includes: providing a computer, in combination with both the combing machine and the other fiber processing machines located upstream of the combing machine, as a signal-generating means; and allocating the computer to one of the combing machine, as a machine control unit, and a group of machines, as one of a group control unit, and a process control computer.

Frequently, long-term and short-term fluctuations in evenness are distinguished, with the long-term changes being known as "fluctuations in count" (or "drift") and short-term fluctuations as "CV fluctuations". Provided that the word "evenness" is not specially qualified in the present specification, it refers both to long-term as well as short-term fluctuations. Due to its operating mode, the combing machine per se is a known source of short-term fluctuations of previously known or determinable periodicity. Therefore, means can be provided to eliminate signal components of the respective periodicity from the analysis or long-term fluctuations (maintenance of count) might be taken into account only.

In the preferred embodiment the fibre mass measuring device is provided as an element of a controlled drafting arrangement. In this case the above-mentioned signal-generating means (e.g. a computer) does not necessarily respond directly to a signal supplied by the measuring device. The signal generating means (the computer) may, for example, be responsive to signals which are generated in the control unit (e.g. for changing the draft in the drafting arrangement). Such signals are derived from the fibre mass scanned by the measuring device.

Where a computer is provided as a signal-generating means, it can be allocated to a machine (e.g. as a machine control unit). Preferably, however, it is allocated to a group of machines (e.g. as a group control unit or even as a process control computer).

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components.

The invention is now outlined in greater detail by reference to an embodiment, whereby said embodiment is shown as a further development of the combing machine in accordance with FIG. 7 of Swiss application No. 1841/91.

In the drawings:

Figure 1:
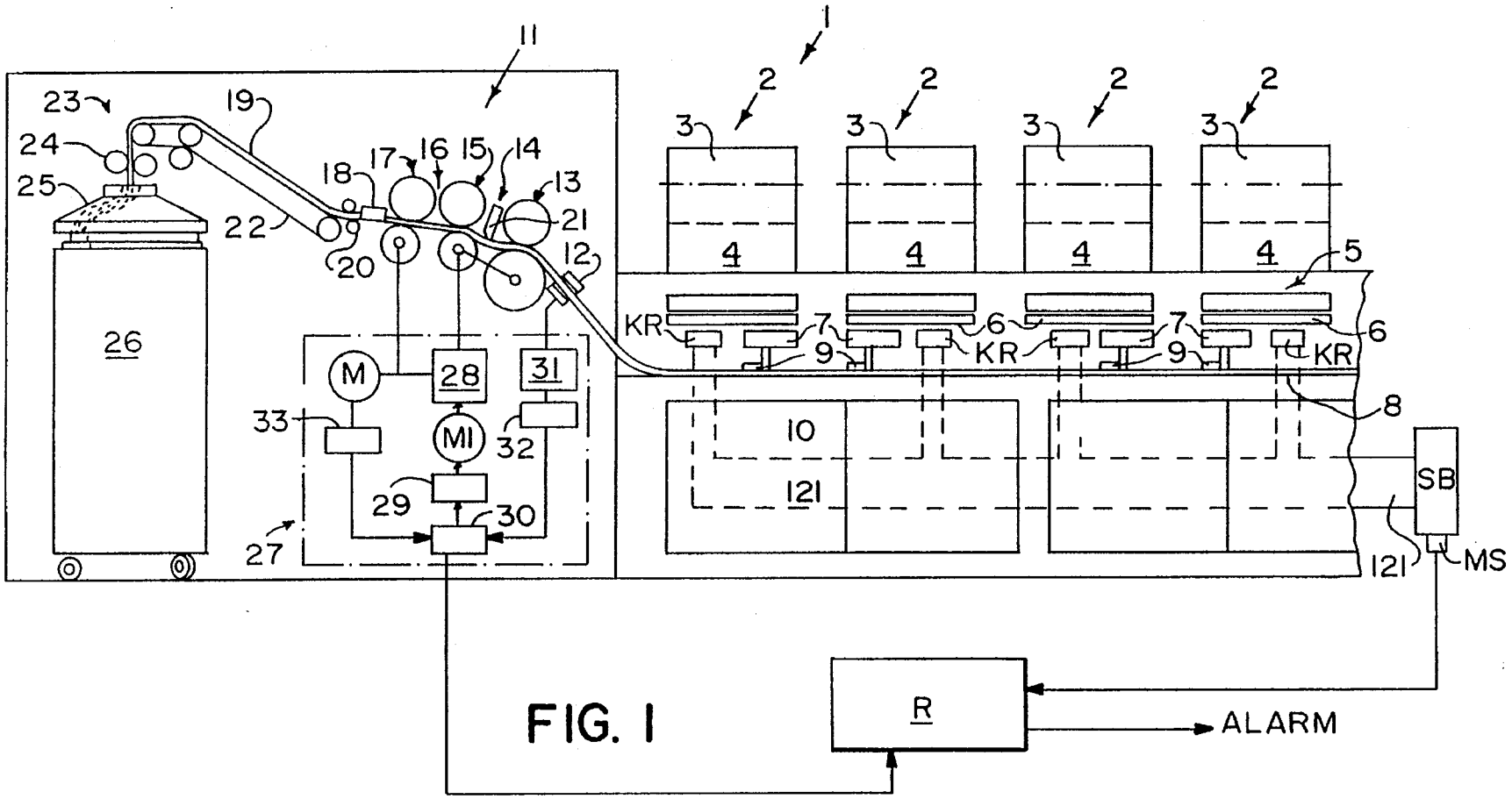
Figure 2:
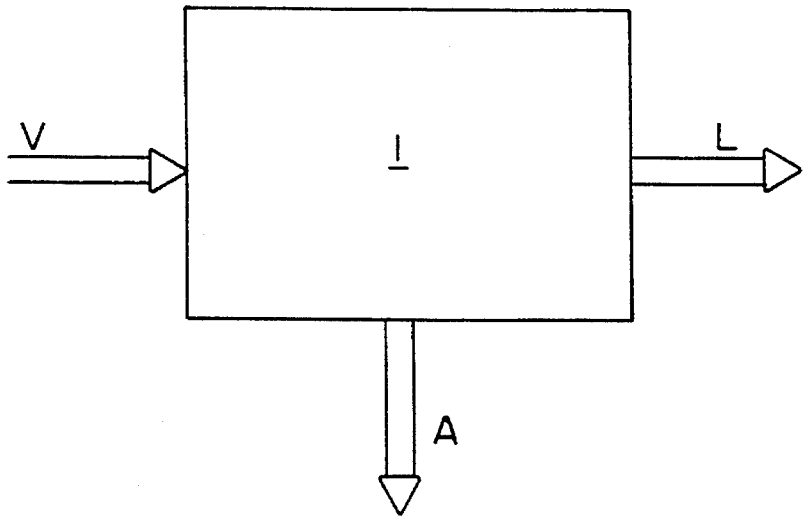
Figure 3:
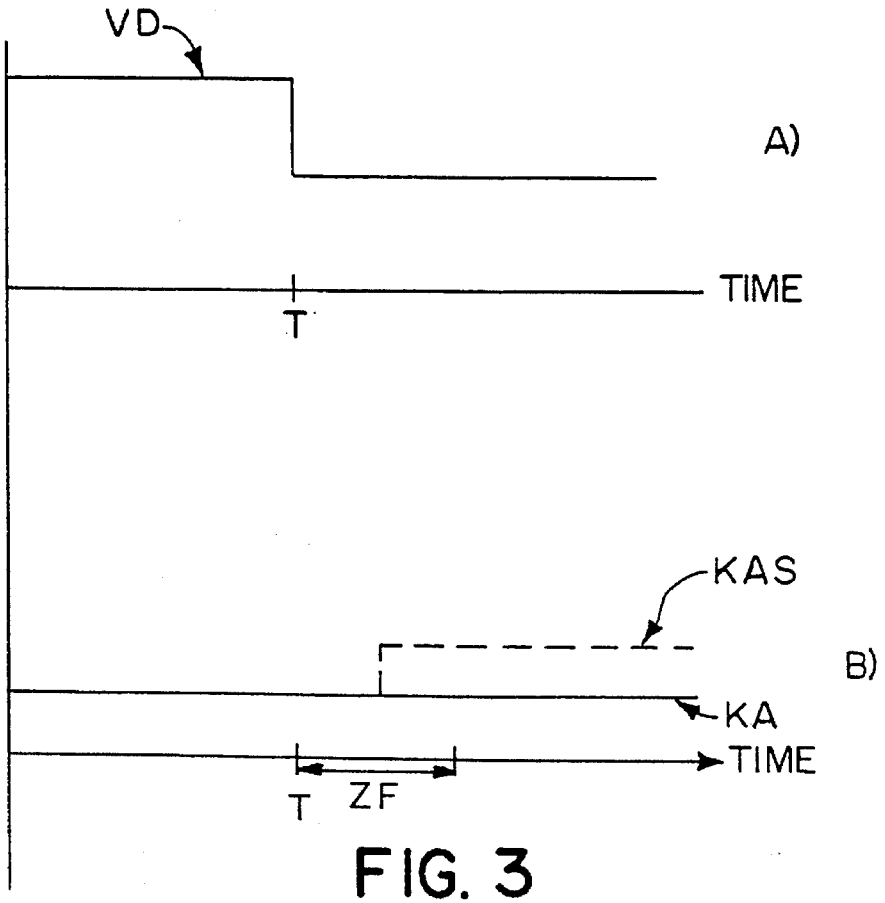
Figure 4:
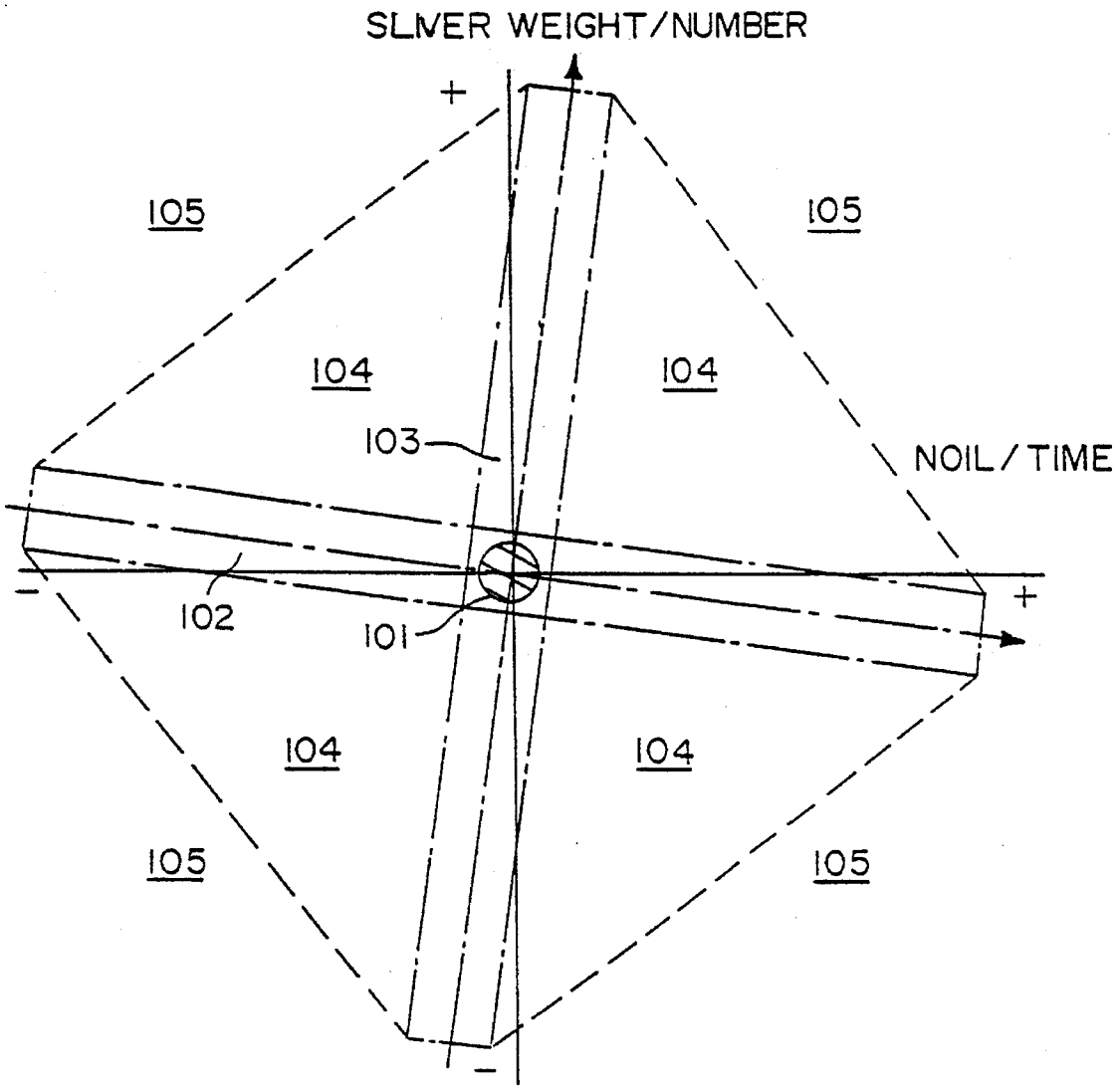

FIG. 1 schematically shows a combing machine with a controlled drafting arrangement and an apparatus for determining the share of comber waste;

FIG. 2 (a copy of FIG. 10 of the patent application No. PCT/CH91/00140) schematically shows the material flow ratios in the combing machine on the basis of the continuity equation;

FIG. 3 shows possible signals 3A and 3B for explaining the principle; and FIG. 4 shows an evaluation diagram for the signals.

DETAILED DESCRIPTION OF THE PREFERRED EMBODIMENTS

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

FIG. 1 is derived from FIG. 1 of prior former Swiss patent application No. 4754/88, also assigned to the assignee of this invention and shows a schematic side view of a combing machine with a controlled drafting arrangement. Only the basic structure of a combing machine (without taking the drafting arrangement control into account) will be discussed at first.

FIG. 1 shows a combing machine 1, e.g. with eight combing heads 2, of which only four are shown in the drawing. A lap roll 3 is situated on carrier rollers (not shown) in every combing head 2, whose laps 4 are supplied to the combing apparatus 5 via a feed device (not shown). The combing apparatus 5 consists, as is well known, of a nipper arrangement, a round comb provided below said nipper arrangement and a top comb arranged behind the nipper arrangement as seen in the conveying direction with subsequent detaching rollers.

The combed fibre fleece is supplied by the detaching rollers to a draw-off funnel (not shown) via a delivery table 6 (FIG. 1). The fibre fleece is joined into a sliver or combed sliver in the draw-off funnel. This process is supported by a pair of draw-off rollers 7 which is subsequently arranged behind the respective draw-off funnel. This pair of draw-off rollers 7 supplies the combed sliver to an outlet table 8. In order to convey slivers 10 next to one another on outlet table 8, sliver guiding means 9 are provided which are offset with respect to one another in the horizontal direction, e.g. in accordance with Swiss patent application No. 1498/90 of Jul. 2, 1990, also assigned to the assignee of this invention.

The slivers 10 guided parallel with respect to one another reach a drafting arrangement 11. A measuring device 12 is provided at the entrance to drafting arrangement 11 which scans the thickness of the incoming slivers (fibre mass). The measuring device 12 can be based on different principles, e.g. it can be optical, mechanical or capacitive.

After the passage through the measuring device 12, the slivers arrive between the input rollers 13 of a preliminary draft zone 14 at a pair of middle rollers 15 which are simultaneously the delivery rollers for a subsequent main drafting zone 16. The drafted slivers 10 reach a schematically shown sliver funnel 18 via delivery rollers 17 at the exit of the main drafting zone 16. There they are joined into a combed sliver 19 with the help of the draw-off rollers 20. A pressure bar 21 is provided in the preliminary drafting zone for guiding the slivers. Said pressure bar 21 could also be arranged in the main drafting zone.

The combed sliver 19 supplied by the draw-off rollers reaches a conveyor belt 22 and is supplied to a can press 23. Combed sliver 19 is deposited in a can 26 via calendar rolls 24 and the funnel wheel 25.

The shorter fibres are picked up by the wire setting of the round comb and removed from the round comb by a comb cleaning device. Tile cleaning device KR supplies said separated short fibres to a suction duct 121 which passes all eight combing heads 5 and conveys the waste from all said heads to a collecting container 5B. The separated material can be reused, for example, within a suitable recycling process, which is not of importance in connection with tile present invention and which therefore shall not be described herein in greater detail.

It is desired in accordance with previously noted PCT/CH90/00140 to obtain a signal which is equivalent to the share in short fibres of the feed material for the combing room. This must be carried out by a suitable arrangement of measuring sensors. In principle it would be possible to measure or determine the proportion of short fibres in each combing head individually, which would ensure a highly precise supervision of the combing stage per se. Such an arrangement, however, would lead to very high investment and maintenance costs and to considerable efforts required in setting the various measuring devices.

In a preferred embodiment the shale in short fibres is not determined or measured per combing head, but per machine, which only requires one measuring sensor arrangement MS per machine. Said arrangement is connected with a process control computer R for the preliminary stage of the spinning plant. Possibilities for measuring or determining the short fibre share shall not be discussed herein, as they are treated in the above-mentioned Swiss patent application PCT/CH90/00140. The evaluation of the signals from combing machines 1 (FIG. 1) in computer R shall briefly be treated hereinunder.

It is assumed at first that for the short fibre share a set value is to be defined for the upper and lower tolerance thresholds. If the signal supplied to computer R for each combing machine means that the separated proportion of short fibres is within the predefined tolerance range, there is no reason for computer R to intervene in the process with respect to the staple length. If a change in the signal from a single combing machine indicates that the proportion of short fibres separated from said machine has moved outside of the predefined tolerance range, it should usually be possible to determine a similar deviation in the other machines (processing the same raw material) within a predefinable time interval in case of a fault in the raw material. Computer R should therefore wait at first whether similar deviations from the desired condition can be determined in all machines of the group. When deviations can be determined in only a single machine, then the reason cannot be a fault in the raw material, but only a defect in the respective machine or in the measuring devices connected thereto. Under these circumstances computer R should switch off the affected machine and make a display so that the defect can be eliminated by the staff.

In the event of a simultaneous fluctuation of the measured or determined short fibre share in all combing machines of the group it is evident that a fault in the raw material has occurred. In that case computer R will issue a respective signal, for example, to a process control computer which is responsible for tile control of the area in question. The said computer can then either make a pertinent display, so that respective new adjustments can be carried out by the staff or (by using the various possibilities to influence the staple length) initiate a change in the processing so as to bring about the desired condition in the feed of the combing room.

In the event that contradictory messages are received from the various machines in the combing room, computer R may have to deduce a defect in the plant and initiate a respective alarm.

FIG. 2 shows a diagram for explaining the different possibilities for measuring or determining the short fibre share in the feed material of a specific combing machine 1. The arrows indicate the material flow. Arrow V indicates the supply of the feed material in machine 1. Arrow L indicates the supply of the intermediate product (sliver) to the machine and arrow A shows the discharge (of the comber waste).

When V, A and L are regarded as material quantities per time unit, the relationships can be represented by the following equations:

$$V-A=L \quad (1) \text{ or}$$

$$A=V-L$$

From this follows that the short fibre share (KFA) can be determined by the following equation:

$$KFA=\frac{A}{V}=\frac{V-L}{V}=\frac{A}{L+A} \quad (3)$$

This means that the short fibre share can be determined by measuring A and V or by measuring V and L or by measuring A and L. The discharged quantity A should be measured or determined in combing machine 1 itself. The feed quantity V could be provided by a preparatory stage, for example. Delivery L can be determined in can press 23 (FIG. 1).

The combing machine exerts a clearly ascertainable influence on the staple diagram of the raw material to be spun in that said machine separates the shorter fibres from the process. The discharged quantity (quantity of comber waste) in the combing machine clearly represents this influence, because comber waste is made up with respect to its quantity nearly completely of short fibres (the dirt content of the comber waste and the neps contained therein are negligible in this connection). For given settings of the combing machine and for a given arrangement of the feed lap (lap thickness or the degree of parallelization of the fibres) the discharge quantity provides a direct indicator of the short fibre share. This statement applies to present combing machines. If in future the percentage of dirt or neps increases in the comber waste to such an extent that it can no longer be neglected, solid contents of these components could be determined by random samples in the laboratory. The combing machine itself can be set in such a way that fibres shorter than a certain length are separated, so that the subsequent stages are protected from problems relating to short fibres.

The final result of the spinning process depends, however, on many other influencing factors, in particular on the yarn count and on the CV values for such slivers. For this reason it is particularly Beneficial to arrange the drafting arrangement 11 (FIG. 1) as an autoleveller draw frame. For the sake of completeness the control device 27 for drafting arrangement 11 will be briefly explained hereinunder too. The arrangement shown, however, is not the preferred embodiment of the controlled drafting arrangement and shall be regarded only as an illustration of the principle of the control.

In the example of FIG. 1 a combing machine 1 is shown with a drafting arrangement 11, with the drive of the lower roller of the pairs of roller 13, 15 and 17 being provided by the main motor M. A planet gear 28 is interposed for the drive of the lower roller 15 and the drive of lower roller 13 is taken directly from lower roller 15. The planet gear 28 is allocated to a control motor M1 which is controlled by a control device 29. The control device 29 contains a set value for the speed from a set point stage 30, in which the measured voltage initiated by the measuring device 12 via a signal converter 31 and timer 32 is arithmetically compared with the control voltage issued by the master tachometer 33 of main motor M, which results in a set voltage with a disturbance-variable feed-forward system for the control device.

Before the entry into the calender rolls 24 a fibre mass measuring unit could be additionally provided for monitoring the combed sliver, whereby the signal produced could be fed to the control unit. This, however, is not absolutely necessary and is therefore not shown. Where such an additional measuring unit is provided, it jointly forms with the control unit a control loop which is usually provided for controlling deviations in long-wave changes in evenness (maintenance of yarn count).

If a difference in the set value for the sliver thickness is determined in the measuring device 12 or the additional unit, control motor M1 is activated via control device 27, which motor engages in the planet gear and which causes a change in speed of the middle roller 15 and thus also the input roller 13, whereas the speed of delivery roller 17 remains unchanged. This means that the draft is adjusted due to the changed difference in speed between middle roller 15 and delivery roller 17 of the determined sliver thickness by measuring device 12 or an additional measuring unit 120 (not shown). To protect the combing machine per se from said change in speed in the drafting arrangement inlet, a buffer storage unit may be provided-in front of the drafting arrangement.

In a further preferred embodiment (not shown) the controlled draft zone is situated between pairs of rollers 15 and 17 and the pair of rollers 17 is provided with a variable speed. The sliver storage is situated in this case between the drafting arrangement outlet and the can press. It is also possible that drafting arrangements of different arrangements with other control devices than the embodiment shown are used, as was already described in greater detail in CH-841/91.

From the control device 29 and/or the set point stage a signal is gained which is supplied to computer R. This signal is representative of the levelling work provided by the drafting arrangement and is therefore derived (indirectly) from any fluctuations in mass determined by the measuring device 12.

In addition, computer R supervises the comber waste share in relationship to the fluctuations of evenness determined in the drafting arrangement. A change in evenness determined in the inlet of the drafting arrangement can principally be based on one or both of the following causes:

1) A change in evenness in a lap roll which is used as feed for the combing head and/or 2) a change in the mixture, leading to a change in the comber waste share.

When a change in evenness is determined in a drafting arrangement without determining simultaneously a change in the comber waste share (or the share in short fibres), one can deduce a change in the feed to be combed, If, however, a change in evenness in the drafting arrangement inlet (or in the drafting arrangement outlet) and a change in the comber waste share or short fibre share is determined simultaneously, it is not possible to simply deduce a change in evenness in the lap roll.

The share in comber waste can be defined as a ratio between the comber waste quantity and the respective feed material quantity supplied to the combing machine. In this respect it is not necessary to determine this ratio per se so as to determine the comber waste share. It is sufficient to form a value that can be derived from this ratio. The ratio of the comber waste share to the respectively supplied combed sliver quantity can be derived, for example, by the above-mentioned continuity equation from the ratio of comber waste quantity to the feed quantity to be combed and serves accordingly also as a measure for the comber waste share.

To determine changes in evenness it is important to determine the comber waste quantity (dirt and short fibres). As was already mentioned in previously noted PCT application No. PCT/CH91/00140, the comber waste quantity is usually sufficient for determining the short fibre share because the proportion of dirt is casually negligible. If this is not the case, it is necessary with respect to the evenness to use the comber waste share, whereby the comber waste share has to be broken down into short fibre and dirt shares for the evaluation of the comber waste share.

FIG. 3 schematically shows possible time relationships of changes in the signals from the drafting arrangement measuring sensor 12 and from the comber waste measuring apparatus MS. It is assumed at first that a sliver has broken during the feed to the lap-forming machine (disposed in front of the combing machine), which leads to a fault in the evenness of the lap.

As the lap-forming machine does not comprise any levelling, the fault takes full effect in the inlet of a combing head and thus in the supplied combed sliver of said combing head. The fleece thickness VD determined in the drafting arrangement inlet (measuring sensor 12) therefore drops at time T (a levelled "drop" of the signal in a possible outlet sensor would be noticed soon later, whereupon the control unit would take full action to eliminate this fault from the sliver supplied by the combing machine, i.e. to level it out). The amplitude and the slope of the signal sampling is clearly excessive in FIG. 3, which was made so as to present the principle with more clarity.

The mixing ratio remains unaffected by the sliver breakage in the lap-forming machine. The comber waste measuring apparatus MS will not notice any change in this case and signal KA representative of the comber waste share remains unchanged. Computer R can deduce a change in the evenness of a previous machine and searches for this fault at first in the own area of the spinning plant. If in the area controlled by process control computer R such a fault cannot be recognized, computer R issues an alarm signal, for example to process control computer of an area disposed in front of computer R (e.g. blow room or carding room) and/or to an alarm display which requires the intervention on the part of the operating staff. This procedure has already been disclosed in PCT/CH91/00140 and shall not be repeated hereinunder.

However, it is now assumed that the fault is based on a change in the mixture. There has not been a sliver breakage. Thus, the short fibre share has been increased considerably. This is indicated in a clearly risen comber waste share KAS and a substantial decrease in the supplied combed sliver quantity.

Owing to the time delay in the measuring system this effect will only be noticeable first in the inlet to the drafting arrangement under the assumption of time T (FIG. 3). This time, however, a rise in the comber waste share KAS can be noticed within a time window ZF, so that computer R does not have to search for an evenness fault in the previous machines. The procedure after determining a mixing fault has been described in previous applications and shall not be repeated hereinunder.

The signal curves in accordance with FIG. 3 have been strongly simplified for the illustration. In day-to-day operations continuous smaller fluctuations of the measured values are determined. Preferably, thresholds ("tolerance bandwidths") are defined both for the evenness as well as for the comber waste share, so that computer R only has to react to one of the fluctuations of either the one or the other value when it travels outside of said bandwidth.

The shortwave fluctuations in evenness of the machines disposed in front of the combing machine are usually levelled out by the combing process itself. After the combing usually only medium-wave to long-wave faults in evenness of the previously disposed machines are noticeable. The combing machine itself, however, is a source of shortwave fluctuations in mass which can then be levelled out by the drafting arrangement.

The occurrence of shortwave changes in the signal supplied to computer R should not lead instantly to a search for the sources of this fault before the combing machine itself. The computer can be equipped, for example, with a "filter" (software module) to eliminate such shortwave changes, or it can be programmed in such a way that the signal from the drafting arrangement is subjected to a spectroscopic analysis, for example, and that in the event of shortwave changes the fault is searched at least first in the affected machine.

The controlled drafting arrangement is not substantial for realizing the present invention. It is sufficient if fibre mass fluctuations can be determined after the combing, i.e., the device 12 (FIG. 1) could be directly connected with the computer and the shown control could be dropped without dropping the invention. The use in combination width the automatic control of the drafting arrangement, however, is preferable.

The scanning of the supplied fibre mass could naturally be carried out for each combing head separately. This, however, would usually cause superfluous expenses.

FIG. 4 schematically shows a possible evaluation diagram, on the basis of which respective interventions can be made in the process via computer R. The respective signals comber waste quantity/time and yarn weight/yarn count during constant delivery are represented here in a coordinate system and are evaluated by the computer according to the position.

When the evaluated signal is located in zone 101, no intervention is required in the process.

When, however, the evaluated signal moves to zone 102, then this leads to a indicator on the influence of the short fibre share, by which, according to the indication, an intervention is made in a previous processing stage where the mixture (staple) is determinable.

When the signal is located in zone 103, then this leads to a conclusion on the yarn count/lap count, which can then be transmitted via computer R to process stages provided in front for control purposes.

As soon as the evaluated signal is located in zone 104, it concerns a mixed signal which allows making conclusions on a drifting yarn count/lap count and on a changed mixture.

From this information it is also possible to transmit pertinent control instructions to previous processing stages via computer R. The evaluation can be also made on the basis of preset values gained from experience.

When the signal is located in zone 105, there is a fault in the sensor system, in the automatic control unit or in the combing machine itself. In this event an alarm is raised and the machine is stopped.

What is claimed is:

1. A combing machine with a fiber mass measuring device arranged after the combing heads of the combing machine, the combing machine being in combination with other fiber processing machines located upstream of the combing machine, the combing machine comprising:

means for determining the comber waste occurring in the combing machine; and means for generating a signal representative of the evenness behaviour of the fiber mass being supplied to the combing machine, the signal-generating means being responsive both to the fiber mass determined by the measuring device as well as to the determination of the comber waste, so that a change in the evenness behaviour of the fiber processing machines located upstream of the combing machine is only deduced in the event that the comber waste share remains within preset tolerances while the evenness of the fiber mass as scanned by the measuring device changes.

2. The machine of claim 1 wherein the fiber mass measuring device is provided as an element of a controlled drafting arrangement including a control unit.

3. The machine of claim 2, wherein a computer is provided, in combination with both the combing machine and the other fiber processing machines located upstream of the combing machine, as the signal-generating means and that the computer is allocated to one of the combing machine, as a machine control unit, and a group of machines, as one of a group control unit, and a process control computer.

4. The machine of claim 2 wherein the signal-generating means is only indirectly responsive to a signal supplied by the fiber mass measuring device.

5. The machine of claim 4, wherein a computer is provided, in combination with both the combing machine and the other fiber processing machines located upstream of the combing machine, as the signal-generating means and that the computer is allocated to one of the combing machine, as a machine control unit, and a group of machines, as one of a group control unit, and a process control computer.

6. The machine of claim 4, wherein the signal generating means is responsive to signals which are generated in the control unit.

7. The machine of claim 6, wherein a computer is provided, in combination with both the combing machine and the other fiber processing machines located upstream of the combing machine, as the signal-generating means and that the computer is allocated to one of the combing machine, as a machine control unit, and a group of machines, as one of a group control unit, and a process control computer.

8. A method for a combing machine with a fiber mass measuring device arranged after the combing heads of the combing machine, the combing machine being in combination with other fiber processing machines located upstream of the combing machine, the method comprising:

monitoring both the evenness of the fiber material supplied by the combing heads of the combing machine as well as the comber waste share; and forming a signal representative of a change in the evenness behaviour of the fiber processing machines located upstream of the combing machine when the evenness of the fiber material being monitored changes while the comber waste share remains unchanged.

9. The method of claim 8, further including: determining thresholds for both comber waste share and evenness, so that a change will only be recognized as such in the event that one of the thresholds is exceeded.

10. The method of claim 9, further including: providing the fiber mass measuring device as an element of a controlled drafting arrangement including a control unit.

11. The method of claim 10, further including signal generating means, wherein the signal generating means is only indirectly responsive to a signal supplied by the measuring device.

12. The method of claim 11, further including: generating signals, with the signal generating means being responsive to the control signal.

13. The method of claim 12, further including: providing a computer, in combination with both the combing machine and the other fiber processing machines located upstream of the combing machine, as the signal-generating means; and allocating the computer to one of the combing machine, as a machine control unit, and a group of machines, as one of a group control unit, and a process control computer.

14. The method of claim 11, further including: providing a computer, in combination with both the combing machine and the other fiber processing machines located upstream of the combing machine, as the signal-generating means; and allocating the computer to one of the combing machine, as a machine control unit, and a group of machines, as one of a group control unit, and a process control computer.

15. The method of claim 10, further including: providing a computer, in combination with both the combing machine and the other fiber processing machines located upstream of the combing machine, as a signal-generating means; and allocating the computer to one of the combing machine, as a machine control unit, and a group of machines, as one of a group control unit, and a process control computer.

16. The method of claim 8, further including: providing the fiber mass measuring device as an element of a controlled drafting arrangement including a control unit.

17. The method of claim 16, further including signal generating means, wherein the signal generating means is only indirectly responsive to a signal supplied by the measuring device.

18. The method of claim 17, further including: generating signals, with the signal generating means being responsive to the control signal.

19. The method of claim 18, further including: providing a computer, in combination with both the combing machine and the other fiber processing machines locates upstream of the combing machine, as the signal-generating means; and allocating the computer to one of the combing machine, as a machine control unit, and a group of machines, as one of a group control unit, and a process control computer.

20. The method of claim 17, further including: providing a computer, in combination with both the combing machine and the other fiber processing machines located upstream of the combing machine, as a signal-generating means; and allocating the computer to one of the combing machine, as a machine control unit, and a group of machines, as one of a group control unit, and a process control computer.

21. The method of claim 16, further including: providing a computer, in combination with both the combing machine and the other fiber processing machines located upstream of the combing machine, as a signal-generating means; and allocating the computer to one of the combing machine, as a machine control unit, and a group of machines, as one of a group control unit, and a process control computer.

* * * * *